US011454126B1

(12) United States Patent
Jaramillo et al.

(10) Patent No.: US 11,454,126 B1
(45) Date of Patent: Sep. 27, 2022

(54) BLADE ROOT SHANK PROFILE

(71) Applicant: DOOSAN HEAVY INDUSTRIES & CONSTRUCTION CO., LTD., Changwon-si (KR)

(72) Inventors: Andres Jaramillo, Jupiter, FL (US); Clinton Mayer, Jupiter, FL (US); Jinwoo Song, Changwon (KR)

(73) Assignee: DOOSAN HEAVY INDUSTRIES & CONSTRUCTION CO., LTD., Changwon-si (KR)

( * ) Notice: Subject to any disclaimer, the term of this patent is extended or adjusted under 35 U.S.C. 154(b) by 0 days.

(21) Appl. No.: 17/410,618

(22) Filed: Aug. 24, 2021

(51) Int. Cl.
*F01D 5/30* (2006.01)

(52) U.S. Cl.
CPC ..... *F01D 5/3007* (2013.01); *F05D 2220/32* (2013.01); *F05D 2240/301* (2013.01); *F05D 2240/303* (2013.01); *F05D 2240/304* (2013.01); *F05D 2240/305* (2013.01); *F05D 2240/306* (2013.01)

(58) Field of Classification Search
CPC ..... F01D 5/141; F01D 5/3007
See application file for complete search history.

(56) References Cited

U.S. PATENT DOCUMENTS 8,007,245 B2 8/2011 Brittingham et al.

*Primary Examiner* — Igor Kershteyn
*Assistant Examiner* — John S Hunter, Jr.
(74) *Attorney, Agent, or Firm* — Shook, Hardy & Bacon, L.L.P.

(57) ABSTRACT

Turbine components, such as blades, having a shank portion with an uncoated, nominal profile substantially in accordance with Cartesian coordinate values of X, Y, and Z set forth in Table 1, Table 2, or Table 1 and Table 2. X and Y are distances in inches which, when connected by smooth continuing arcs, define shank portion profile section edges at each Z distance in inches. The shank portion profile section edges at the Z distances are joined smoothly with one another to form a complete shank shape.

14 Claims, 5 Drawing Sheets

BLADE ROOT SHANK PROFILE

TECHNICAL FIELD

The present invention generally relates to axial turbine components having a shank. More specifically, the present invention relates to a shank profile for turbine components, such as blades, that have a variable thickness and three-dimensional ("3D") shape along the component span in order to balance the mass distribution, shift the natural frequency, improve airfoil mean stress and dynamic stress capabilities, and minimize risk of failure due to cracks caused by excitation of the component.

BACKGROUND

Gas turbine engines, such as those used for power generation or propulsion, include a turbine section. The turbine section includes a casing and a rotor that rotates about an axis within the casing. In axial-flow turbines, the rotor typically includes a plurality of rotor discs that rotate about the axis. A plurality of turbine blades extend away from, and are radially spaced around, an outer circumferential surface of each of the rotor discs. Typically, preceding each plurality of turbine blades is a plurality of turbine nozzles. The plurality of turbine nozzles usually extend from, and are radially spaced around, the casing. Each set of a rotor disc, a plurality of turbine blades extending from the rotor disc, and a plurality of turbine nozzles immediately preceding the plurality of turbine blades is generally referred to as a turbine stage. The radial height of each successive turbine stage increases to permit the hot gas passing through the stage to expand. Specialized shapes of turbine blades and turbine nozzles aid in harvesting energy from the hot gas as it passes through the turbine section.

Turbine components, such as turbine blades, have an inherent natural frequency. When these components are excited by the passing air, as would occur during normal operating conditions of a gas turbine engine, the turbine components vibrate at different orders of engine rotational frequency. When the natural frequency of a turbine component coincides with or crosses an engine order, the turbine component can exhibit resonant vibration that in turn can cause cracking and ultimately failure of the turbine component.

SUMMARY

This summary is intended to introduce a selection of concepts in a simplified form that are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes gas turbine engine components, such as blades, having shank portions that optimize the interaction with other turbine stages, provide for aerodynamic efficiency, and meet aero-mechanical life objectives. More specifically, the turbine components described herein have unique shank thicknesses and 3D shaping that results in the desired mass distribution and natural frequency of the respective turbine component. Further, the shank thicknesses and 3D shaping at specified radial distances along the component span may provide an acceptable level of mean stress in the shank sections, and also provide improved shank aerodynamics and efficiency while maintaining the desired natural frequency of the turbine component.

The shank portion of the turbine components disclosed herein have a particular shape or profile as specified herein. In some aspects, a pressure side of an uncoated shank profile may be defined by at least some of the Cartesian coordinate values of X, Y, and Z set forth in Table 1. In this example, the Z coordinate values are distances measured perpendicular to the turbine centerline and the X and Y coordinate values for each Z distance define points along a pressure side surface of the shank. The points along the pressure side surface are then connected with smooth continuing arcs to define the 3D pressure side surface of the shank portion of the turbine component.

In other aspects, a suction side of an uncoated shank profile may be defined by at least some of the Cartesian coordinate values of X, Y, and Z set forth in Table 2. In this example, the Z coordinate values are distances measured perpendicular to the turbine centerline and the X and Y coordinate values for each Z distance define points along a suction side surface of the shank. The points along the suction side surface are then connected with smooth continuing arcs to define the 3D suction side surface of the shank portion of the turbine component.

In further aspects, a pressure side of an uncoated shank profile may be defined by at least some of the Cartesian coordinate values of X, Y, and Z set forth in Table 1 and a suction side of an uncoated shank profile may be defined by at least some of the Cartesian coordinate values of X, Y, and Z set forth in Table 2. In this example, the Z coordinate values are distances measured perpendicular to the turbine centerline and the X and Y coordinate values for each Z distance define points along a pressure side surface of the shank or the suction side surface of the shank, respectively. The points along the pressure side surface are then connected with smooth continuing arcs to define the 3D pressure side surface of the shank portion of the turbine component and the points along the suction side surface are then connected with smooth continuing arcs to define the 3D suction side surface of the shank portion of the turbine component.

BRIEF DESCRIPTION OF THE DRAWINGS

The embodiments disclosed herein relate to compressor component airfoil designs and are described in detail with reference to the attached drawing figures, which illustrate non-limiting examples of the disclosed subject matter, wherein.

DETAILED DESCRIPTION

Figure 1:
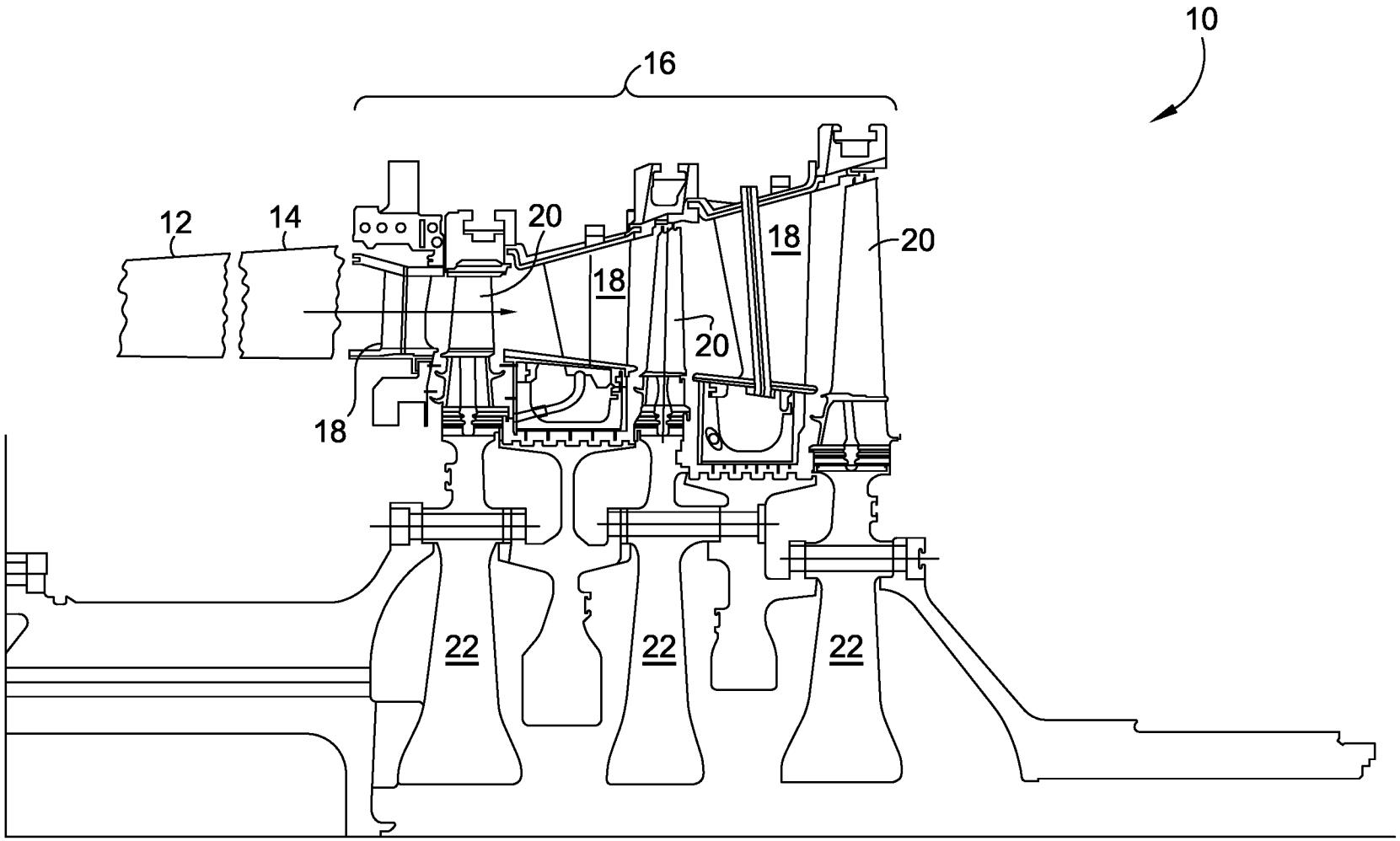
FIG. 1 depicts a schematic view of a gas turbine engine, in accordance with aspects hereof.

The subject matter of this disclosure is described herein to meet statutory requirements. However, this description is not intended to limit the scope of the invention. Rather, the claimed subject matter may be embodied in other ways, to include different steps, combinations of steps, features, and/or combinations of features, similar to those described in this disclosure, and in conjunction with other present or future technologies.

In brief, and at a high level, this disclosure describes gas turbine engine components, such as blades, having shank portions that optimize the interaction with other turbine stages, provide for aerodynamic efficiency, and meet aeromechanical life objectives. More specifically, the turbine components described herein have unique shank thicknesses and 3D shaping that results in the desired mass distribution and natural frequency of the respective turbine component. Further, the shank thicknesses and 3D shaping at specified radial distances along the component span may provide an acceptable level of mean stress in the shank sections, and also provide improved shank aerodynamics and efficiency while maintaining the desired natural frequency of the turbine component.

The shank portion of the turbine components disclosed herein have a particular shape or profile as specified herein. In some aspects, a pressure side of an uncoated shank profile may be defined by at least some of the Cartesian coordinate values of X, Y, and Z set forth in Table 1. In this example, the Z coordinate values are distances measured perpendicular to the turbine centerline and the X and Y coordinate values for each Z distance define points along a pressure side surface of the shank. The points along the pressure side surface are then connected with smooth continuing arcs to define the 3D pressure side surface of the shank portion of the turbine component.

In other aspects, a suction side of an uncoated shank profile may be defined by at least some of the Cartesian coordinate values of X, Y, and Z set forth in Table 2. In this example, the Z coordinate values are distances measured perpendicular to the turbine centerline and the X and Y coordinate values for each Z distance define points along a suction side surface of the shank. The points along the suction side surface are then connected with smooth continuing arcs to define the 3D suction side surface of the shank portion of the turbine component.

In further aspects, a pressure side of an uncoated shank profile may be defined by at least some of the Cartesian coordinate values of X, Y, and Z set forth in Table 1 and a suction side of an uncoated shank profile may be defined by at least some of the Cartesian coordinate values of X, Y, and Z set forth in Table 2. In this example, the Z coordinate values are distances measured perpendicular to the turbine centerline and the X and Y coordinate values for each Z distance define points along a pressure side surface of the shank or the suction side surface of the shank, respectively. The points along the pressure side surface are then connected with smooth continuing arcs to define the 3D pressure side surface of the shank portion of the turbine component and the points along the points along the suction side surface are then connected with smooth continuing arcs to define the 3D suction side surface of the shank portion of the turbine component.

Referring now to FIG. 1, there is illustrated a portion of a gas turbine engine 10. The gas turbine engine 10 includes a compressor 12 (represented schematically), a combustor 14 (represented schematically), and a turbine 16. The turbine 16 includes multiple turbine stages, each having a turbine nozzle 18 and a turbine blade 20. The turbine 16 depicted in FIG. 1 includes three turbine stages, but other aspects may include greater or fewer number of stages. The turbine 16 has a first stage nearest the combustor 14, a second stage following the first stage, and a third stage following the second stage. Each stage also includes a rotor disc 22. At each stage, a plurality of the turbine blades 20 are circumferentially spaced around and coupled to the rotor disc 22.

Figure 2:
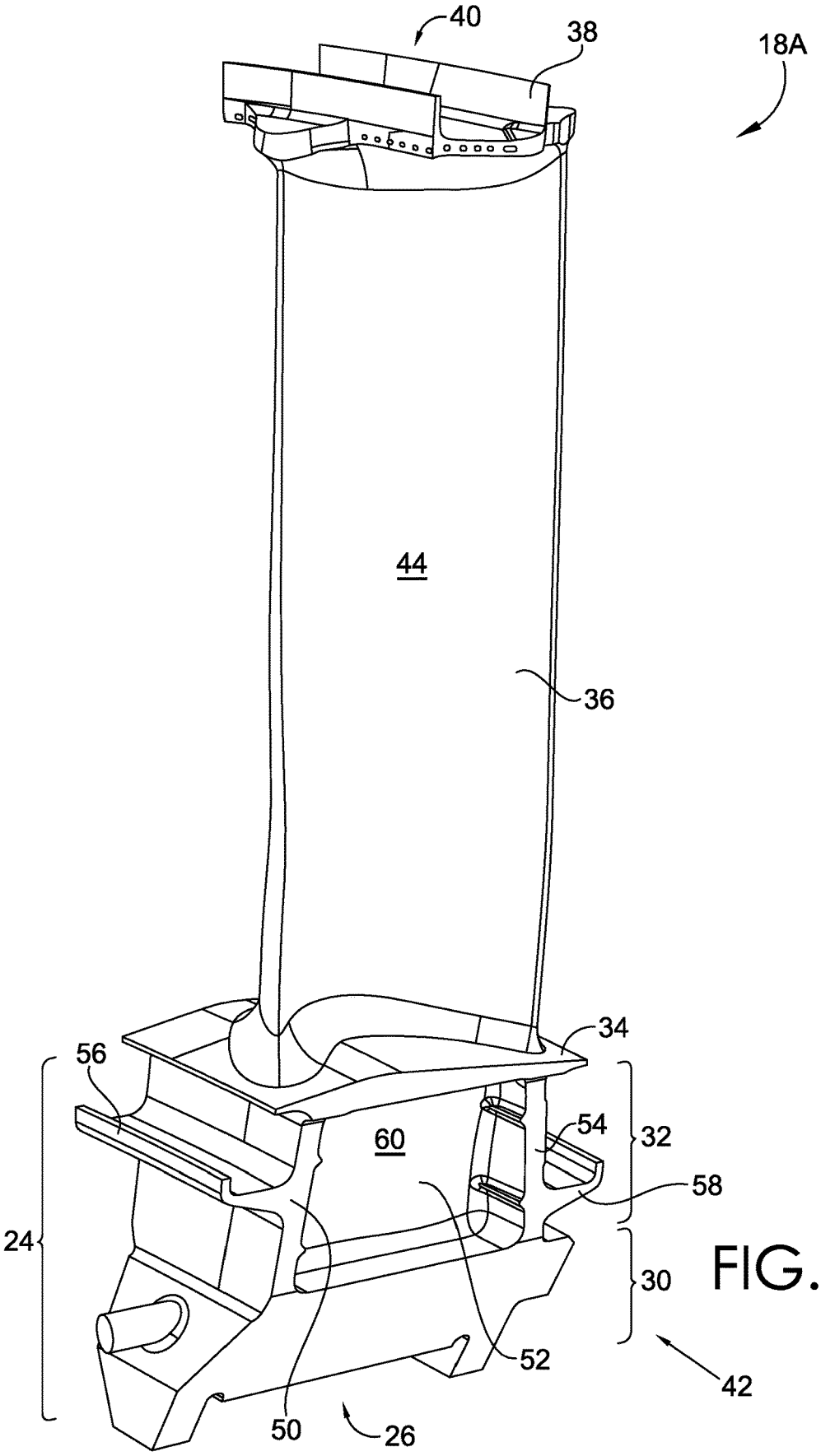
FIG. 2 depicts a perspective view of a pressure side of a turbine component, in accordance with aspects hereof.

One aspect of a turbine component comprises a turbine blade 18A, as depicted in FIGS. 2-5. Referring initially to FIG. 2, the turbine blade 18A comprises a root portion 24 configured to be coupled to the rotor disc 22. The root portion 24 extends from proximal end 26 (relative to the rotor disc 22 when coupled thereto) to a platform 34. The root portion 26 may include a dovetail 30 and a shank 32. The illustrated dovetail 30 is shown as cast, but unfinished in FIGS. 2-5. Following casting, a machining process is utilized to shape aspects of the dovetail 30 such that slots or fir tree shapes are formed in the axial direction along the dovetail 30. When the turbine blade 18A is coupled to the rotor disc 22, the dovetail 30 may be received within a slot in the rotor disc 22. The shank 32 may extend distally from the top of the dovetail 30 to a platform 34. Extending distally away from the platform 34 is an airfoil 36, which extends to a tip shroud 38 at a distal end 40 of the turbine blade 18A.

Figure 3:
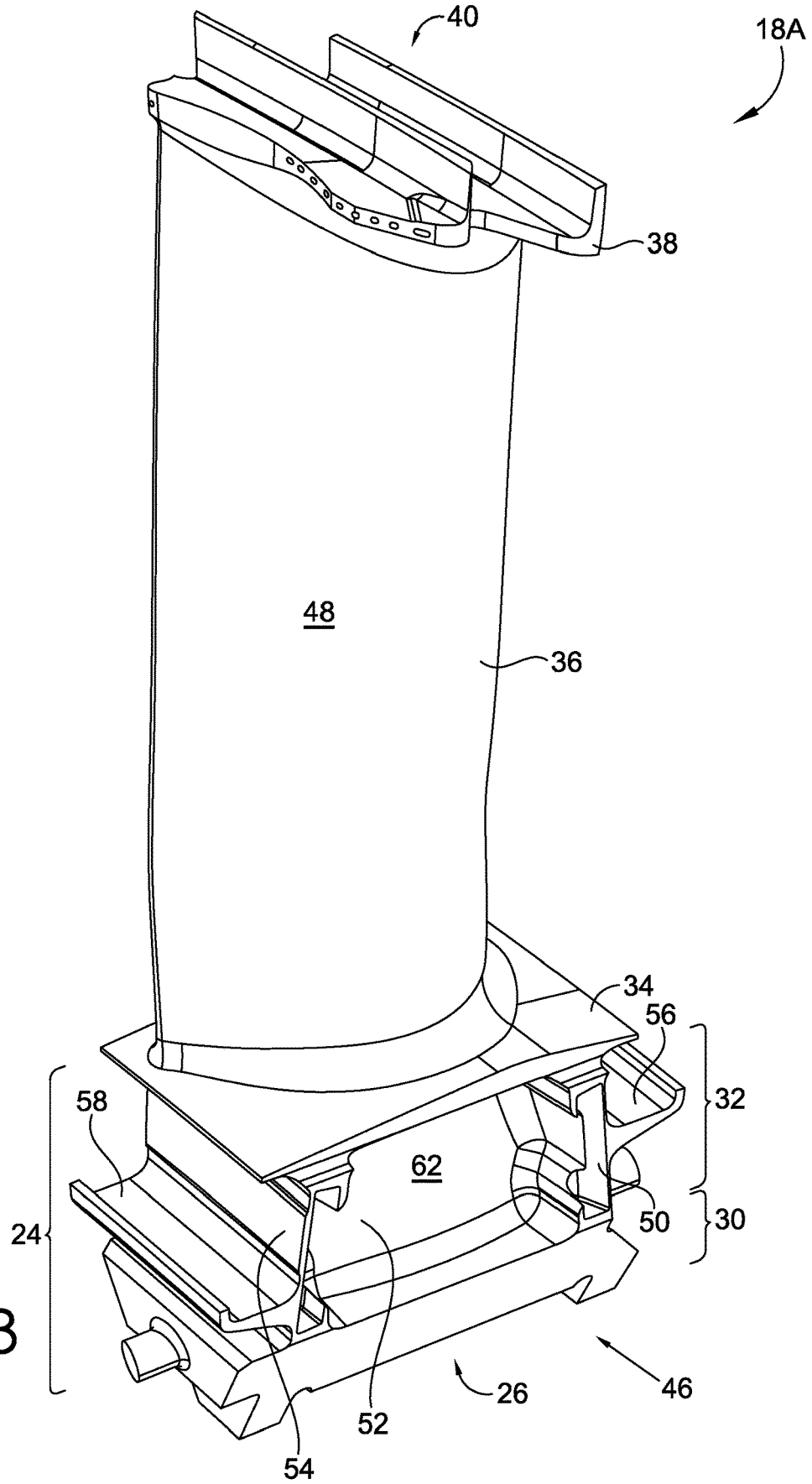
FIG. 3 depicts a perspective view of a suction side of the turbine component of FIG. 2, in accordance with aspects hereof.

The turbine blade 18A includes a pressure side (best seen in FIG. 2) and a suction side (best seen in FIG. 3). The pressure side of the turbine blade 18A corresponds to a pressure side 42 of the shank 32 and a pressure side 44 of the airfoil 36. Likewise, the suction side of the turbine blade 18A corresponds to a suction side 46 of the shank 32 and a suction side 48 of the airfoil 36.

As seen in FIGS. 2 and 3, the shank 32 includes a leading edge 50, a shank body 52, and a trailing edge 54. The leading edge 50 may have one or more a leading edge wings 56 projecting upstream (when the turbine blade 18A is coupled to a rotor disc 22) from the leading edge 50. Similarly, the trailing edge 54 may have one or more trailing edge wings 58 projecting downstream (when the turbine blade 18A is coupled to the rotor disc 22). The shank body 52 includes a pressure side surface 60 extending laterally between the leading edge 50 and the trailing edge 54 and extending radially between the dovetail 30 and the platform 34. The pressure side surface 60 has a generally concave profile shape, as discussed below. The shank body 52 also includes a suction side surface 62 extending laterally between the leading edge 50 and the trailing edge 54 and extending radially between the dovetail 30 and the platform 34. The suction side surface 62 has a generally convex profile shape, as discussed below.

Figure 4:
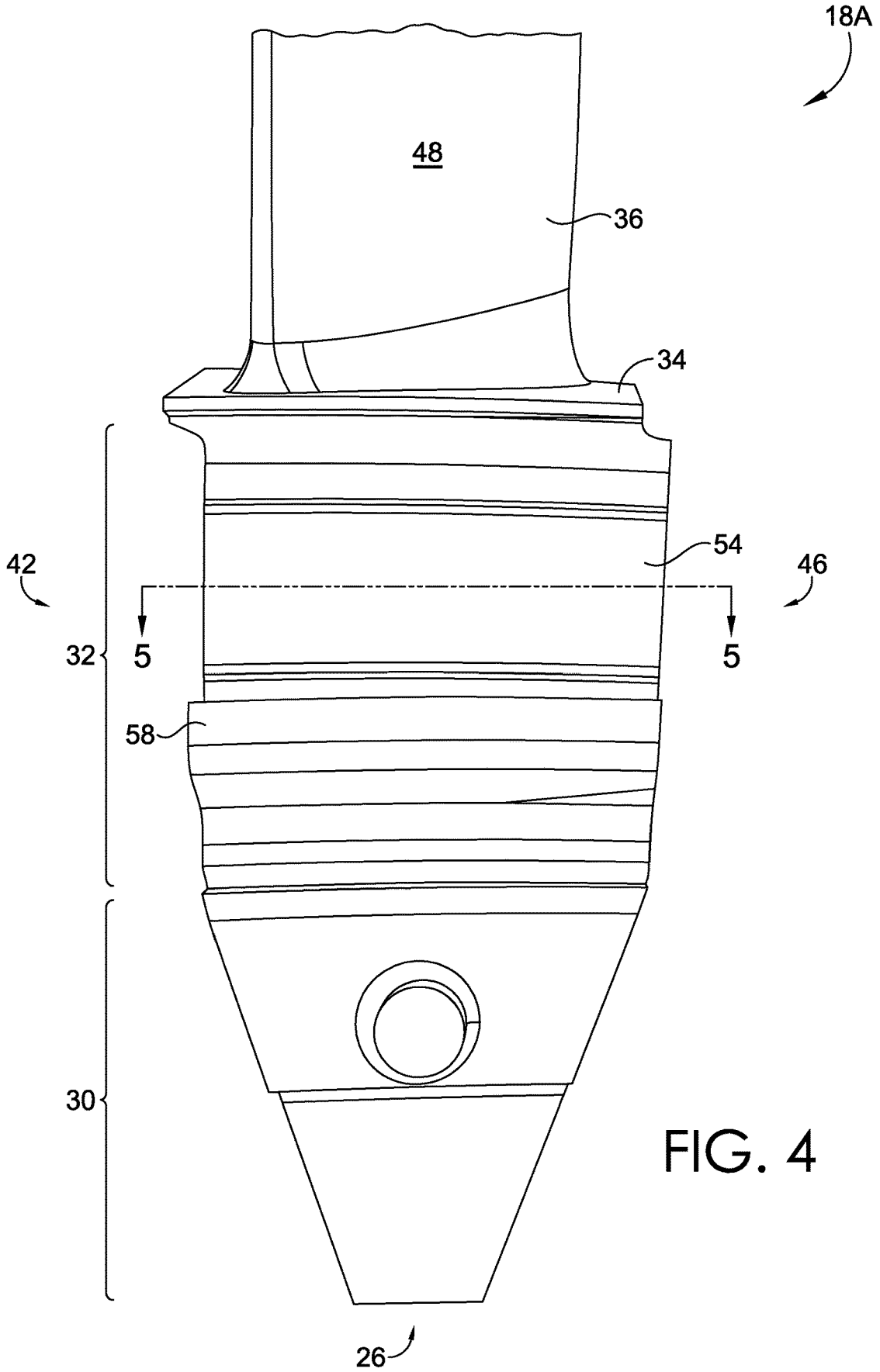
FIG. 4 depicts a detail view of a trailing side of the turbine component of FIG. 2, in accordance with aspects hereof.

Turning to FIG. 4, a rear elevation view of a portion of the turbine blade 18A depicts the dovetail 30, the trailing edge 54 of the shank 32, a trailing edge wing 58, the platform 34, and the airfoil 36. When assembled, a plurality of turbine blades 18 are coupled to the rotor disc 22 of a given turbine stage and form an annular array of blades around the rotor disc. A cross-section is taken along cut-line 5-5 to illustrate the concave and convex shape of the respective pressure side and suction side surfaces of the shank 32.

Figure 5:
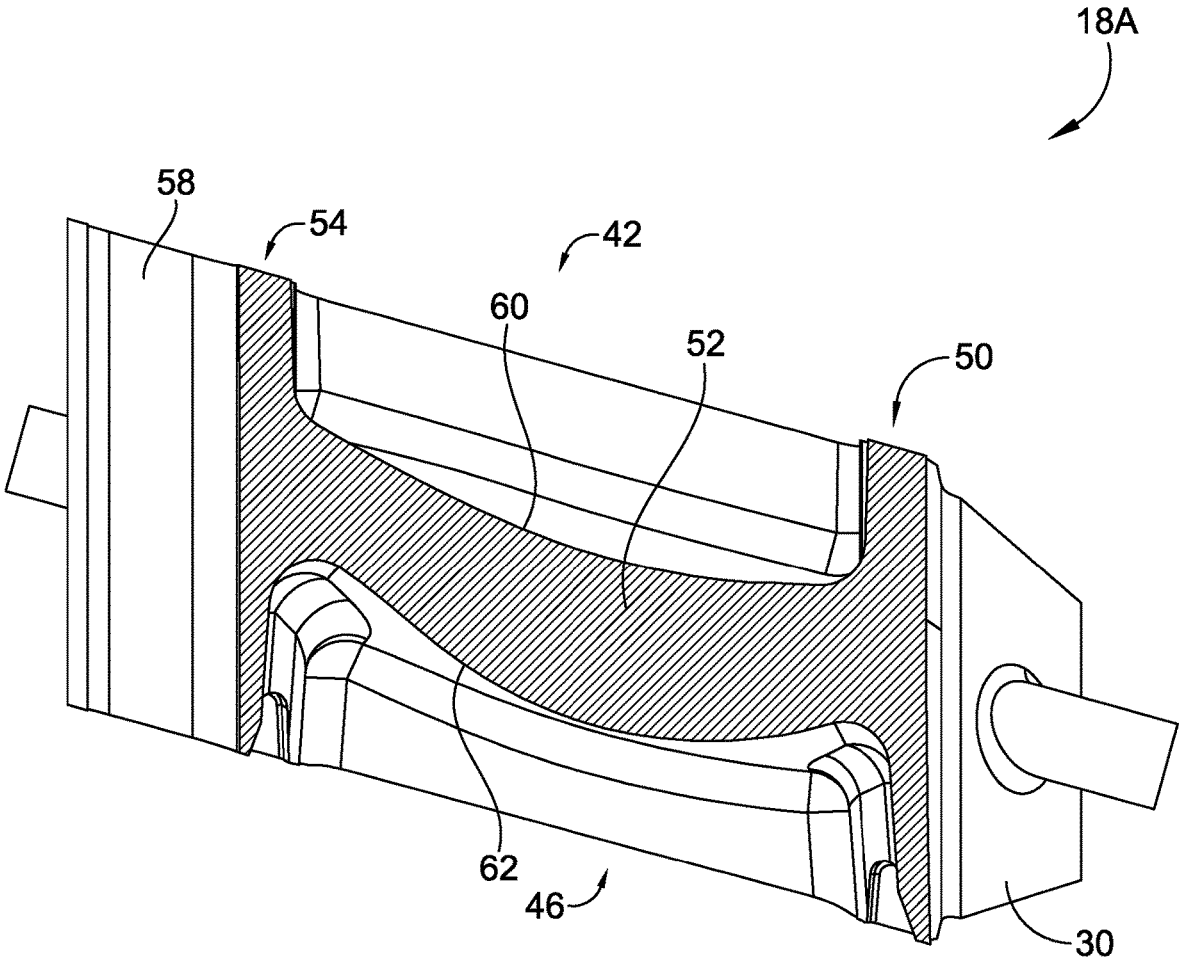
FIG. 5 depicts a cross-section of the turbine component of FIG. 2 taken along cut-line 5-5 in FIG. 4, in accordance with aspects hereof.

FIG. 5 illustrates the cross-section taken along cut-line 5-5. In the illustrated aspect, the shank body 52 is depicted as a solid mass. In some aspects, however, one or more cooling circuits may extend through the turbine blade 18A and be present in the shank body 52. For example, an opening at the distal end of the dovetail 30 may receive coolant from a coolant supply and communicate that coolant through one or more of the dovetail 30, the shank 32, the platform 34, the airfoil 36, and the tip shroud 38. In this example, the coolant may exit the turbine blade 18A through cooling holes formed in any of the above referenced portions of the turbine blade 18A.

As seen in FIG. 5, a thickness of the shank body 52 between the leading edge 50 to the trailing edge 54 varies laterally across the shank body 52. In other words, the distance from the pressure side surface 60 to the suction side surface 62 increases or decreases along the lateral span of the shank body 52. Similarly, a thickness of the shank body 52 between the dovetail 30 and the platform 34 varies across the radial direction of the shank body 52.

By changing the shank thickness, 3D shaping, and/or the distribution of material along the span of the shank body 52 of the turbine component, the natural frequency of the turbine component may be altered. This may be advantageous for the operation of the turbine 10. For example, during operation of the turbine 10, the turbine component may move (e.g., vibrate) at various modes due to the geometry, temperature, and aerodynamic forces being applied to the turbine component. These modes may include bending, torsion, and various higher-order modes.

If excitation of the turbine component occurs for a prolonged period of time with a sufficiently high amplitude then the turbine component can fail due to high cycle fatigue. For example, a critical first bending mode frequency of a turbine component may be approximately twice the 60 Hz rotation frequency of the gas turbine engine. For this mode, the first bending mode must avoid the critical frequency range of 110-130 Hz to prevent resonance of the bending mode with the excitation associated with turbine (or engine) rotation. Modifying the thickness, and/or the 3D shape of the turbine component, and in particular that of the shank portion thereof, results in altering the natural frequency of the compressor component. Continuing with the above example, modifying the thickness and/or the 3D shape of the turbine component in accordance with the disclosure herein may result in the first bending natural frequency being shifted to be between 65 Hz and 110 Hz, in accordance with some aspects. In other aspects, the first bending natural frequency may be shifted to be between about 70 Hz to about 105 Hz. This first bending natural frequency of the turbine component will therefore be between the $1^{st}$ and $2^{nd}$ engine order excitation frequencies when the turbine is rotating at 60 Hz. More specifically, a pressure side shank portion with the thickness and/or the 3D shape as defined by the Cartesian coordinates set forth in Table 1, or a suction side shank portion with the thickness and/or 3D shape as defined by the Cartesian coordinates set forth in Table 2, or both said pressure side shank portion and suction side shank portion as defined by the Cartesian coordinates set forth in Table 1 and Table 2, respectively, will result in the turbine component having a natural frequency of first bending between $1^{st}$ and $2^{nd}$ engine order excitations. In other aspects, a turbine component having a pressure side shank portion, a suction side shank portion, or both, with the thickness and/or the 3D shape as defined by the Cartesian coordinates set forth in Table 1 and/or Table 2, respectively, will have a natural frequency of first bending at least 5-10% greater than $1^{st}$ engine order excitations and at least 5-10% less than $2^{nd}$ engine order excitations. In fact, a turbine component having a pressure side shank portion, a suction side shank portion, or both, with the thickness and/or the 3D shape as defined by the Cartesian coordinates set forth in Table 1 and/or Table 2, respectively, will have a natural frequency for the lowest few vibration modes of at least 5-10% less than or greater than each engine order excitation. For example, the turbine component may have a natural frequency 12% less than the $2^{nd}$ engine order excitation when the turbine is rotating at 60 Hz.

In one embodiment disclosed herein, a nominal 3D shape of a pressure side shank portion and a suction side shank portion, such as the shank portion 32 shown in FIGS. 2-5, of a gas turbine engine component may be defined by a set of X, Y, and Z coordinate values measured in a Cartesian coordinate system. For example, one such set of coordinate values are set forth, in inches, in Table 1 below for the pressure side shank portion and another set of coordinate values are set forth, in inches, in Table 2 below for the suction side shank portion. The Cartesian coordinate system includes orthogonally related X, Y, and Z axes. The positive X, Y, and Z directions are axial toward the exhaust end of the turbine, tangential in the direction of engine rotation, and radially outward toward the static case, respectively. Each Z distance is measured from an axially-extending centerline of the turbine 10 (which, in aspects, may also be a centerline of the gas turbine engine). The X and Y coordinates for each distance Z may be joined smoothly (e.g., such as by smooth continuing arcs, splines, or the like) to thereby define a surface perimeter of a section of the shank portion of the turbine component at the respective Z distance. Each of the defined sections of the shank profile is joined smoothly with an adjacent section of the shank profile in the Z direction to form a complete nominal 3D shape of the shank portion.

The coordinate values set forth in Table 1 below are for a cold condition of the turbine component (e.g., non-rotating state and at room temperature). Further, the coordinate values set forth in Table 1 below are for an uncoated nominal 3D shape of the turbine component. In some aspects, a coating (e.g., corrosion protective coating) may be applied to the turbine component. The coating thickness may be up to about 0.010 inches thick.

Further, the turbine component may be fabricated using a variety of manufacturing techniques, such as forging, casting, milling, electro-chemical machining, electric-discharge machining, and the like. As such, the turbine component may have a series of manufacturing tolerances for the position, profile, twist, and chord that can cause the turbine component to vary from the nominal 3D shape defined by the coordinate values set forth in Table 1 and/or Table 2. This manufacturing tolerance may be, for example, +/−0.120 inches in a direction away from any of the coordinate values of Table 1 without departing from the scope of the subject matter described herein. In other aspects, the manufacturing tolerances may be +/−0.080 inches. In still other aspects, the manufacturing tolerances may be +/−0.020 inches.

In addition to manufacturing tolerances affecting the overall size of the turbine component, it is also possible to scale the turbine component to a larger or smaller size. In order to maintain the benefits of this 3D shape, in terms of stiffness and stress, it is necessary to scale the turbine component uniformly in the X, Y, and Z directions. However, since the Z values in Table 1 and Table 2 are measured from a centerline of the turbine rather than a point on the turbine component, the scaling of the Z values must be relative to the minimum Z value in Table 1 or Table 2, respectively. For example, the first (i.e., radially innermost) profile section is positioned approximately 36.049 inches from the turbine centerline and the second profile section is positioned approximately 36.379 inches from the engine centerline. Thus, if the turbine component was to be scaled 20% larger, each of the X and Y values in Table 1 may simply be multiplied by 1.2. However, each of the Z values must first be adjusted to a relative scale by subtracting the distance from the turbine centerline to the first profile section (e.g., the Z coordinates for the first profile section become Z=0, the Z coordinates for the second profile section become Z=0.330 inches, etc.). This adjustment creates a nominal Z value. After this adjustment, then the nominal Z values may be multiplied by the same constant or number as were the X and Y coordinates (1.2 in this example).

The Z values set forth in Table 1 and Table 2 may assume a turbine sized to operate at 60 Hz. In other aspects, the turbine component described herein may also be used in different size turbines (e.g., a turbine sized to operate at 50 Hz, etc.). In these aspects, the turbine component defined by the X, Y, and Z values set forth in Table 1 may still be used, however, the Z values would be offset to account for the radial spacing of the differently sized turbines and components thereof (e.g., rotors, discs, blades, casing, etc.). The Z values may be offset radially inwardly or radially outwardly, depending upon whether the turbine is smaller or larger than the turbine envisioned by Table 1 and Table 2. For example, the rotor to which a blade is coupled may be spaced farther from the turbine centerline (e.g., 20%) than that envisioned by Table 1 and Table 2. In such a case, the minimum Z values (i.e., the radially innermost profile section) would be offset a distance equal to the difference in rotor disc size (e.g., the radially innermost profile section would be positioned approximately 43.259 inches from the engine centerline instead of 36.049 inches) and the remainder of the Z values would maintain their relative spacing to one another from Table 1 and Table 2 with the same scale factor as being applied to X and Y (e.g., if the scale factor is one then the second profile section would be positioned approximately 43.589 inches from the engine centerline—still 0.330 inches radially outward from the first profile section). Stated another way, the difference in spacing of the rotor disc from the centerline would be added to all of the scaled Z values in Table 1 and Table 2.

Equation (1) provides another way to determine new Z values (e.g., scaled or translated) from the Z values listed in Table 1 when changing the relative size and/or position of the component defined by Table 1. In equation (1), $Z_1$ is the Z value from Table 1, $Z_{1min}$ is the minimum Z value from Table 1, scale is the scaling factor, $Z_{2min}$ is the minimum Z value of the component as scaled and/or translated, and $Z_2$ is the resultant Z value for the component as scaled and/or translated. Of note, when merely translating the component, the scaling factor in equation (1) is 1.00.

$$Z_2=[(Z_1-Z_{1min})*\text{scale}+Z_{2min}] \quad (1)$$

The turbine component described herein may be used in a land-based turbine in connection with a land-based gas turbine engine. Typically, turbine components in such a turbine experience temperatures below approximately 1,450 degrees Fahrenheit. As such, these types of compressor components may be fabricated from various alloys. For example, these compressor components may be made from a stainless-steel alloy.

In yet another aspect, the airfoil profile may be defined by a portion of the set of X, Y, and Z coordinate values set forth in Table 1 (e.g., at least 85% of said coordinate values).

TABLE 1

| X | Y | Z |
|---|---|---|
| 57.161 | −0.781 | 38.359 |
| 57.169 | −0.634 | 38.359 |
| 57.177 | −0.487 | 38.359 |
| 57.190 | −0.342 | 38.359 |

TABLE 1-continued

| X | Y | Z |
|---|---|---|
| 57.268 | −0.220 | 38.359 |
| 57.400 | −0.160 | 38.359 |
| 57.546 | −0.143 | 38.359 |
| 57.692 | −0.124 | 38.359 |
| 57.837 | −0.103 | 38.359 |
| 57.984 | −0.093 | 38.359 |
| 58.130 | −0.094 | 38.359 |
| 58.277 | −0.105 | 38.359 |
| 58.422 | −0.128 | 38.359 |
| 58.565 | −0.161 | 38.359 |
| 58.705 | −0.204 | 38.359 |
| 58.842 | −0.257 | 38.359 |
| 58.974 | −0.321 | 38.359 |
| 59.102 | −0.394 | 38.359 |
| 59.223 | −0.476 | 38.359 |
| 59.339 | −0.566 | 38.359 |
| 59.450 | −0.662 | 38.359 |
| 59.561 | −0.758 | 38.359 |
| 59.672 | −0.854 | 38.359 |
| 59.784 | −0.950 | 38.359 |
| 59.895 | −1.046 | 38.359 |
| 60.005 | −1.142 | 38.359 |
| 60.095 | −1.257 | 38.359 |
| 60.122 | −1.400 | 38.359 |
| 60.130 | −1.547 | 38.359 |
| 60.124 | −1.693 | 38.359 |
| 57.121 | −0.849 | 38.029 |
| 57.129 | −0.697 | 38.029 |
| 57.137 | −0.546 | 38.029 |
| 57.144 | −0.394 | 38.029 |
| 57.194 | −0.253 | 38.029 |
| 57.315 | −0.166 | 38.029 |
| 57.465 | −0.147 | 38.029 |
| 57.616 | −0.131 | 38.029 |
| 57.766 | −0.109 | 38.029 |
| 57.917 | −0.094 | 38.029 |
| 58.068 | −0.090 | 38.029 |
| 58.220 | −0.098 | 38.029 |
| 58.370 | −0.117 | 38.029 |
| 58.519 | −0.148 | 38.029 |
| 58.664 | −0.190 | 38.029 |
| 58.807 | −0.243 | 38.029 |
| 58.944 | −0.307 | 38.029 |
| 59.077 | −0.381 | 38.029 |
| 59.203 | −0.464 | 38.029 |
| 59.324 | −0.556 | 38.029 |
| 59.440 | −0.654 | 38.029 |
| 59.556 | −0.752 | 38.029 |
| 59.672 | −0.850 | 38.029 |
| 59.787 | −0.948 | 38.029 |
| 59.903 | −1.045 | 38.029 |
| 60.019 | −1.143 | 38.029 |
| 60.126 | −1.250 | 38.029 |
| 60.165 | −1.394 | 38.029 |
| 60.173 | −1.546 | 38.029 |
| 60.181 | −1.697 | 38.029 |
| 57.119 | −0.837 | 37.699 |
| 57.131 | −0.685 | 37.699 |
| 57.143 | −0.532 | 37.699 |
| 57.156 | −0.380 | 37.699 |
| 57.186 | −0.231 | 37.699 |
| 57.302 | −0.138 | 37.699 |
| 57.454 | −0.126 | 37.699 |
| 57.606 | −0.113 | 37.699 |
| 57.758 | −0.094 | 37.699 |
| 57.911 | −0.084 | 37.699 |
| 58.064 | −0.086 | 37.699 |
| 58.216 | −0.099 | 37.699 |
| 58.367 | −0.123 | 37.699 |
| 58.516 | −0.159 | 37.699 |
| 58.662 | −0.205 | 37.699 |
| 58.804 | −0.262 | 37.699 |
| 58.941 | −0.329 | 37.699 |
| 59.073 | −0.407 | 37.699 |
| 59.200 | −0.492 | 37.699 |
| 59.325 | −0.580 | 37.699 |
| 59.449 | −0.670 | 37.699 |
| 59.574 | −0.759 | 37.699 |

TABLE 1-continued

| X | Y | Z |
|---|---|---|
| 59.699 | −0.847 | 37.699 |
| 59.824 | −0.936 | 37.699 |
| 59.949 | −1.024 | 37.699 |
| 60.074 | −1.111 | 37.699 |
| 60.159 | −1.234 | 37.699 |
| 60.175 | −1.386 | 37.699 |
| 60.186 | −1.538 | 37.699 |
| 60.197 | −1.691 | 37.699 |
| 57.064 | −0.811 | 37.369 |
| 57.072 | −0.655 | 37.369 |
| 57.080 | −0.498 | 37.369 |
| 57.089 | −0.342 | 37.369 |
| 57.143 | −0.198 | 37.369 |
| 57.271 | −0.113 | 37.369 |
| 57.427 | −0.104 | 37.369 |
| 57.584 | −0.099 | 37.369 |
| 57.740 | −0.091 | 37.369 |
| 57.897 | −0.092 | 37.369 |
| 58.053 | −0.102 | 37.369 |
| 58.208 | −0.122 | 37.369 |
| 58.362 | −0.152 | 37.369 |
| 58.514 | −0.191 | 37.369 |
| 58.663 | −0.239 | 37.369 |
| 58.809 | −0.296 | 37.369 |
| 58.951 | −0.363 | 37.369 |
| 59.088 | −0.438 | 37.369 |
| 59.223 | −0.517 | 37.369 |
| 59.358 | −0.597 | 37.369 |
| 59.493 | −0.677 | 37.369 |
| 59.627 | −0.757 | 37.369 |
| 59.761 | −0.838 | 37.369 |
| 59.895 | −0.919 | 37.369 |
| 60.029 | −1.001 | 37.369 |
| 60.158 | −1.089 | 37.369 |
| 60.227 | −1.226 | 37.369 |
| 60.236 | −1.383 | 37.369 |
| 60.245 | −1.539 | 37.369 |
| 60.253 | −1.696 | 37.369 |
| 57.036 | −0.793 | 37.039 |
| 57.044 | −0.634 | 37.039 |
| 57.052 | −0.475 | 37.039 |
| 57.061 | −0.317 | 37.039 |
| 57.121 | −0.173 | 37.039 |
| 57.256 | −0.093 | 37.039 |
| 57.414 | −0.092 | 37.039 |
| 57.573 | −0.098 | 37.039 |
| 57.731 | −0.107 | 37.039 |
| 57.890 | −0.121 | 37.039 |
| 58.047 | −0.142 | 37.039 |
| 58.203 | −0.169 | 37.039 |
| 58.359 | −0.203 | 37.039 |
| 58.513 | −0.243 | 37.039 |
| 58.665 | −0.288 | 37.039 |
| 58.815 | −0.340 | 37.039 |
| 58.963 | −0.398 | 37.039 |
| 59.108 | −0.462 | 37.039 |
| 59.252 | −0.528 | 37.039 |
| 59.396 | −0.597 | 37.039 |
| 59.538 | −0.667 | 37.039 |
| 59.680 | −0.739 | 37.039 |
| 59.820 | −0.814 | 37.039 |
| 59.959 | −0.891 | 37.039 |
| 60.096 | −0.971 | 37.039 |
| 60.219 | −1.069 | 37.039 |
| 60.264 | −1.219 | 37.039 |
| 60.272 | −1.378 | 37.039 |
| 60.281 | −1.536 | 37.039 |
| 60.289 | −1.695 | 37.039 |
| 57.007 | −0.774 | 36.709 |
| 57.016 | −0.614 | 36.709 |
| 57.024 | −0.453 | 36.709 |
| 57.034 | −0.293 | 36.709 |
| 57.108 | −0.154 | 36.709 |
| 57.251 | −0.086 | 36.709 |
| 57.411 | −0.097 | 36.709 |
| 57.570 | −0.118 | 36.709 |
| 57.728 | −0.143 | 36.709 |
| 57.887 | −0.170 | 36.709 |

TABLE 1-continued

| X | Y | Z |
|---|---|---|
| 58.044 | −0.201 | 36.709 |
| 58.201 | −0.234 | 36.709 |
| 58.357 | −0.270 | 36.709 |
| 58.513 | −0.309 | 36.709 |
| 58.668 | −0.351 | 36.709 |
| 58.822 | −0.395 | 36.709 |
| 58.976 | −0.442 | 36.709 |
| 59.128 | −0.492 | 36.709 |
| 59.279 | −0.546 | 36.709 |
| 59.429 | −0.604 | 36.709 |
| 59.577 | −0.666 | 36.709 |
| 59.724 | −0.731 | 36.709 |
| 59.869 | −0.800 | 36.709 |
| 60.012 | −0.873 | 36.709 |
| 60.153 | −0.949 | 36.709 |
| 60.268 | −1.058 | 36.709 |
| 60.300 | −1.213 | 36.709 |
| 60.308 | −1.373 | 36.709 |
| 60.317 | −1.534 | 36.709 |
| 60.325 | −1.694 | 36.709 |
| 56.981 | −0.756 | 36.379 |
| 56.990 | −0.595 | 36.379 |
| 56.999 | −0.434 | 36.379 |
| 57.018 | −0.275 | 36.379 |
| 57.110 | −0.147 | 36.379 |
| 57.262 | −0.103 | 36.379 |
| 57.421 | −0.129 | 36.379 |
| 57.578 | −0.162 | 36.379 |
| 57.735 | −0.199 | 36.379 |
| 57.891 | −0.235 | 36.379 |
| 58.048 | −0.273 | 36.379 |
| 58.204 | −0.311 | 36.379 |
| 58.360 | −0.349 | 36.379 |
| 58.516 | −0.388 | 36.379 |
| 58.672 | −0.428 | 36.379 |
| 58.828 | −0.468 | 36.379 |
| 58.984 | −0.508 | 36.379 |
| 59.139 | −0.550 | 36.379 |
| 59.294 | −0.595 | 36.379 |
| 59.447 | −0.645 | 36.379 |
| 59.598 | −0.698 | 36.379 |
| 59.749 | −0.754 | 36.379 |
| 59.899 | −0.814 | 36.379 |
| 60.047 | −0.877 | 36.379 |
| 60.193 | −0.943 | 36.379 |
| 60.305 | −1.054 | 36.379 |
| 60.334 | −1.211 | 36.379 |
| 60.343 | −1.372 | 36.379 |
| 60.352 | −1.532 | 36.379 |
| 60.361 | −1.693 | 36.379 |
| 56.964 | −0.740 | 36.049 |
| 56.976 | −0.582 | 36.049 |
| 56.987 | −0.424 | 36.049 |
| 57.021 | −0.271 | 36.049 |
| 57.137 | −0.168 | 36.049 |
| 57.292 | −0.159 | 36.049 |
| 57.446 | −0.197 | 36.049 |
| 57.600 | −0.236 | 36.049 |
| 57.753 | −0.275 | 36.049 |
| 57.907 | −0.314 | 36.049 |
| 58.060 | −0.354 | 36.049 |
| 58.213 | −0.394 | 36.049 |
| 58.366 | −0.436 | 36.049 |
| 58.519 | −0.478 | 36.049 |
| 58.672 | −0.520 | 36.049 |
| 58.824 | −0.564 | 36.049 |
| 58.976 | −0.608 | 36.049 |
| 59.128 | −0.653 | 36.049 |
| 59.280 | −0.698 | 36.049 |
| 59.432 | −0.742 | 36.049 |
| 59.584 | −0.786 | 36.049 |
| 59.737 | −0.829 | 36.049 |
| 59.889 | −0.873 | 36.049 |
| 60.041 | −0.917 | 36.049 |
| 60.192 | −0.964 | 36.049 |
| 60.312 | −1.063 | 36.049 |
| 60.350 | −1.215 | 36.049 |
| 60.362 | −1.373 | 36.049 |

TABLE 1-continued

| X | Y | Z |
|---|---|---|
| 60.373 | −1.531 | 36.049 |
| 60.384 | −1.689 | 36.049 |

TABLE 2

| X | Y | Z |
|---|---|---|
| 59.987 | 0.942 | 38.359 |
| 59.976 | 0.785 | 38.359 |
| 59.965 | 0.628 | 38.359 |
| 59.953 | 0.471 | 38.359 |
| 59.941 | 0.314 | 38.359 |
| 59.910 | 0.161 | 38.359 |
| 59.800 | 0.053 | 38.359 |
| 59.646 | 0.035 | 38.359 |
| 59.513 | 0.113 | 38.359 |
| 59.409 | 0.232 | 38.359 |
| 59.306 | 0.350 | 38.359 |
| 59.194 | 0.460 | 38.359 |
| 59.070 | 0.558 | 38.359 |
| 58.937 | 0.641 | 38.359 |
| 58.796 | 0.710 | 38.359 |
| 58.648 | 0.763 | 38.359 |
| 58.495 | 0.800 | 38.359 |
| 58.339 | 0.819 | 38.359 |
| 58.182 | 0.822 | 38.359 |
| 58.025 | 0.809 | 38.359 |
| 57.871 | 0.779 | 38.359 |
| 57.720 | 0.733 | 38.359 |
| 57.567 | 0.705 | 38.359 |
| 57.427 | 0.771 | 38.359 |
| 57.354 | 0.907 | 38.359 |
| 57.341 | 1.064 | 38.359 |
| 57.330 | 1.221 | 38.359 |
| 57.319 | 1.378 | 38.359 |
| 57.308 | 1.535 | 38.359 |
| 57.297 | 1.692 | 38.359 |
| 60.028 | 0.922 | 38.029 |
| 60.016 | 0.761 | 38.029 |
| 60.003 | 0.599 | 38.029 |
| 59.991 | 0.438 | 38.029 |
| 59.979 | 0.276 | 38.029 |
| 59.958 | 0.116 | 38.029 |
| 59.857 | −0.007 | 38.029 |
| 59.701 | −0.043 | 38.029 |
| 59.555 | 0.021 | 38.029 |
| 59.444 | 0.139 | 38.029 |
| 59.336 | 0.260 | 38.029 |
| 59.224 | 0.376 | 38.029 |
| 59.100 | 0.481 | 38.029 |
| 58.966 | 0.573 | 38.029 |
| 58.823 | 0.649 | 38.029 |
| 58.673 | 0.710 | 38.029 |
| 58.518 | 0.755 | 38.029 |
| 58.358 | 0.784 | 38.029 |
| 58.196 | 0.795 | 38.029 |
| 58.034 | 0.789 | 38.029 |
| 57.874 | 0.766 | 38.029 |
| 57.717 | 0.727 | 38.029 |
| 57.560 | 0.692 | 38.029 |
| 57.411 | 0.748 | 38.029 |
| 57.325 | 0.883 | 38.029 |
| 57.310 | 1.044 | 38.029 |
| 57.298 | 1.206 | 38.029 |
| 57.285 | 1.367 | 38.029 |
| 57.272 | 1.529 | 38.029 |
| 57.259 | 1.690 | 38.029 |
| 60.357 | 0.653 | 37.699 |
| 60.339 | 0.470 | 37.699 |
| 60.321 | 0.287 | 37.699 |
| 60.302 | 0.104 | 37.699 |
| 60.283 | −0.079 | 37.699 |
| 60.181 | −0.222 | 37.699 |
| 60.000 | −0.231 | 37.699 |
| 59.827 | −0.169 | 37.699 |

TABLE 2-continued

| X | Y | Z |
|---|---|---|
| 59.675 | −0.065 | 37.699 |
| 59.539 | 0.058 | 37.699 |
| 59.407 | 0.186 | 37.699 |
| 59.278 | 0.317 | 37.699 |
| 59.137 | 0.436 | 37.699 |
| 58.985 | 0.539 | 37.699 |
| 58.822 | 0.625 | 37.699 |
| 58.651 | 0.692 | 37.699 |
| 58.474 | 0.740 | 37.699 |
| 58.292 | 0.769 | 37.699 |
| 58.108 | 0.778 | 37.699 |
| 57.924 | 0.766 | 37.699 |
| 57.743 | 0.735 | 37.699 |
| 57.567 | 0.684 | 37.699 |
| 57.392 | 0.627 | 37.699 |
| 57.209 | 0.615 | 37.699 |
| 57.048 | 0.694 | 37.699 |
| 56.996 | 0.867 | 37.699 |
| 56.979 | 1.050 | 37.699 |
| 56.963 | 1.234 | 37.699 |
| 56.947 | 1.417 | 37.699 |
| 56.932 | 1.600 | 37.699 |
| 60.435 | 0.742 | 37.369 |
| 60.421 | 0.548 | 37.369 |
| 60.408 | 0.353 | 37.369 |
| 60.394 | 0.159 | 37.369 |
| 60.380 | −0.035 | 37.369 |
| 60.311 | −0.213 | 37.369 |
| 60.139 | −0.294 | 37.369 |
| 59.959 | −0.234 | 37.369 |
| 59.805 | −0.115 | 37.369 |
| 59.655 | 0.010 | 37.369 |
| 59.509 | 0.138 | 37.369 |
| 59.364 | 0.269 | 37.369 |
| 59.214 | 0.392 | 37.369 |
| 59.052 | 0.500 | 37.369 |
| 58.880 | 0.591 | 37.369 |
| 58.699 | 0.665 | 37.369 |
| 58.513 | 0.720 | 37.369 |
| 58.321 | 0.756 | 37.369 |
| 58.127 | 0.773 | 37.369 |
| 57.933 | 0.770 | 37.369 |
| 57.739 | 0.748 | 37.369 |
| 57.549 | 0.707 | 37.369 |
| 57.363 | 0.648 | 37.369 |
| 57.175 | 0.606 | 37.369 |
| 57.005 | 0.691 | 37.369 |
| 56.939 | 0.870 | 37.369 |
| 56.925 | 1.065 | 37.369 |
| 56.912 | 1.259 | 37.369 |
| 56.898 | 1.453 | 37.369 |
| 56.885 | 1.648 | 37.369 |
| 60.471 | 0.719 | 37.039 |
| 60.458 | 0.529 | 37.039 |
| 60.444 | 0.338 | 37.039 |
| 60.431 | 0.148 | 37.039 |
| 60.415 | −0.041 | 37.039 |
| 60.313 | −0.197 | 37.039 |
| 60.133 | −0.244 | 37.039 |
| 59.964 | −0.161 | 37.039 |
| 59.811 | −0.047 | 37.039 |
| 59.665 | 0.076 | 37.039 |
| 59.519 | 0.198 | 37.039 |
| 59.369 | 0.316 | 37.039 |
| 59.212 | 0.423 | 37.039 |
| 59.046 | 0.518 | 37.039 |
| 58.874 | 0.599 | 37.039 |
| 58.696 | 0.666 | 37.039 |
| 58.513 | 0.719 | 37.039 |
| 58.326 | 0.757 | 37.039 |
| 58.137 | 0.781 | 37.039 |
| 57.947 | 0.789 | 37.039 |
| 57.756 | 0.782 | 37.039 |
| 57.567 | 0.760 | 37.039 |
| 57.380 | 0.724 | 37.039 |
| 57.195 | 0.680 | 37.039 |
| 57.015 | 0.727 | 37.039 |
| 56.913 | 0.884 | 37.039 |

TABLE 2-continued

| X | Y | Z |
|---|---|---|
| 56.896 | 1.073 | 37.039 |
| 56.883 | 1.264 | 37.039 |
| 56.870 | 1.454 | 37.039 |
| 56.856 | 1.644 | 37.039 |
| 60.506 | 0.693 | 36.709 |
| 60.493 | 0.509 | 36.709 |
| 60.479 | 0.325 | 36.709 |
| 60.466 | 0.141 | 36.709 |
| 60.432 | −0.039 | 36.709 |
| 60.298 | −0.160 | 36.709 |
| 60.118 | −0.163 | 36.709 |
| 59.960 | −0.069 | 36.709 |
| 59.810 | 0.039 | 36.709 |
| 59.668 | 0.156 | 36.709 |
| 59.520 | 0.267 | 36.709 |
| 59.366 | 0.367 | 36.709 |
| 59.205 | 0.458 | 36.709 |
| 59.040 | 0.540 | 36.709 |
| 58.870 | 0.611 | 36.709 |
| 58.696 | 0.673 | 36.709 |
| 58.519 | 0.725 | 36.709 |
| 58.339 | 0.766 | 36.709 |
| 58.158 | 0.797 | 36.709 |
| 57.974 | 0.818 | 36.709 |
| 57.790 | 0.827 | 36.709 |
| 57.606 | 0.826 | 36.709 |
| 57.422 | 0.815 | 36.709 |
| 57.239 | 0.792 | 36.709 |
| 57.057 | 0.788 | 36.709 |
| 56.914 | 0.900 | 36.709 |
| 56.868 | 1.076 | 36.709 |
| 56.855 | 1.260 | 36.709 |
| 56.842 | 1.444 | 36.709 |
| 56.829 | 1.628 | 36.709 |
| 60.304 | 0.786 | 36.379 |
| 60.289 | 0.626 | 36.379 |
| 60.274 | 0.467 | 36.379 |
| 60.259 | 0.307 | 36.379 |
| 60.235 | 0.149 | 36.379 |
| 60.120 | 0.046 | 36.379 |
| 59.962 | 0.052 | 36.379 |
| 59.821 | 0.128 | 36.379 |
| 59.690 | 0.220 | 36.379 |
| 59.556 | 0.308 | 36.379 |
| 59.416 | 0.387 | 36.379 |
| 59.272 | 0.458 | 36.379 |
| 59.126 | 0.525 | 36.379 |
| 58.978 | 0.586 | 36.379 |
| 58.827 | 0.642 | 36.379 |
| 58.675 | 0.692 | 36.379 |
| 58.521 | 0.737 | 36.379 |
| 58.365 | 0.777 | 36.379 |
| 58.208 | 0.811 | 36.379 |
| 58.051 | 0.839 | 36.379 |
| 57.892 | 0.861 | 36.379 |
| 57.732 | 0.878 | 36.379 |
| 57.572 | 0.889 | 36.379 |
| 57.412 | 0.895 | 36.379 |
| 57.252 | 0.907 | 36.379 |
| 57.116 | 0.987 | 36.379 |
| 57.067 | 1.136 | 36.379 |
| 57.051 | 1.296 | 36.379 |
| 57.036 | 1.455 | 36.379 |
| 57.021 | 1.615 | 36.379 |
| 60.255 | 0.789 | 36.049 |
| 60.242 | 0.642 | 36.049 |
| 60.230 | 0.495 | 36.049 |
| 60.204 | 0.350 | 36.049 |
| 60.108 | 0.240 | 36.049 |
| 59.968 | 0.199 | 36.049 |
| 59.828 | 0.243 | 36.049 |
| 59.695 | 0.308 | 36.049 |
| 59.561 | 0.370 | 36.049 |
| 59.425 | 0.430 | 36.049 |
| 59.289 | 0.489 | 36.049 |
| 59.152 | 0.544 | 36.049 |
| 59.014 | 0.596 | 36.049 |
| 58.874 | 0.645 | 36.049 |

TABLE 2-continued

| X | Y | Z |
|---|---|---|
| 58.734 | 0.691 | 36.049 |
| 58.592 | 0.734 | 36.049 |
| 58.449 | 0.773 | 36.049 |
| 58.306 | 0.809 | 36.049 |
| 58.161 | 0.841 | 36.049 |
| 58.016 | 0.870 | 36.049 |
| 57.870 | 0.896 | 36.049 |
| 57.724 | 0.918 | 36.049 |
| 57.577 | 0.937 | 36.049 |
| 57.430 | 0.952 | 36.049 |
| 57.284 | 0.975 | 36.049 |
| 57.169 | 1.064 | 36.049 |
| 57.122 | 1.203 | 36.049 |
| 57.111 | 1.350 | 36.049 |
| 57.101 | 1.498 | 36.049 |
| 57.090 | 1.645 | 36.049 |

Embodiment 1. A turbine component comprising a dovetail portion; a shank portion extending between the dovetail portion and a platform; and an airfoil extending from the platform to a blade tip, the shank portion having an uncoated nominal pressure side profile substantially in accordance with Cartesian coordinate values of X, Y, and Z set forth in Table 1, wherein the X, Y, and Z coordinates are distances in inches measured in a Cartesian coordinate system, wherein, at each Z distance, the corresponding X and Y coordinates, when connected by a smooth continuous arc, define one of a plurality of shank profile section edges, and wherein the plurality of shank profile section edges, when joined together by smooth continuous arcs, form a pressure side shank portion shape.

Embodiment 2. The turbine component of embodiment 1, wherein the dovetail portion, the shank portion, the platform, and the airfoil portion form at least part of a turbine blade.

Embodiment 3. The turbine component of any of embodiments 1-2, wherein the pressure side shank portion shape lies within an envelope of +/−0.120 inches measured in a direction normal to any of the plurality of shank profile section edges.

Embodiment 4. The turbine component of any of embodiments 1-3, wherein the pressure side shank portion shape lies within an envelope of +/−0.080 inches measured in a direction normal to any of the plurality of shank profile section edges.

Embodiment 5. The turbine component of any of embodiments 1-4, wherein the pressure side shank portion shape lies within an envelope of +/−0.020 inches measured in a direction normal to any of the plurality of shank profile section edges.

Embodiment 6. The turbine component of any of embodiments 1-5, wherein the pressure side shank profile is in accordance with at least 85% of the X, Y, and Z coordinate values listed in Table 1.

Embodiment 7. A turbine component comprising a dovetail portion; a shank portion extending between the dovetail portion and a platform; and an airfoil extending from the platform to a blade tip, the shank portion having an uncoated nominal suction side profile substantially in accordance with Cartesian coordinate values of X, Y, and Z set forth in Table 2, wherein the X, Y, and Z coordinates are distances in inches measured in a Cartesian coordinate system, wherein, at each Z distance, the corresponding X and Y coordinates, when connected by a smooth continuous arc, define one of a plurality of shank profile section edges, and wherein the plurality of shank profile section edges, when joined together by smooth continuous arcs, form a suction side shank portion shape.

Embodiment 8. The turbine component of embodiment 7, wherein the dovetail portion, the shank portion, the platform, and the airfoil portion form at least part of a turbine blade.

Embodiment 9. The turbine component of any of embodiments 7-8, wherein the suction side shank portion shape lies within an envelope of +/−0.120 inches measured in a direction normal to any of the plurality of shank profile section edges.

Embodiment 10. The turbine component of any of embodiments 7-9, wherein the suction side shank portion shape lies within an envelope of +/−0.080 inches measured in a direction normal to any of the plurality of shank profile section edges.

Embodiment 11. The turbine component of any of embodiments 7-10, wherein the suction side shank portion shape lies within an envelope of +/−0.020 inches measured in a direction normal to any of the plurality of shank profile section edges.

Embodiment 12. The turbine component of any of embodiments 7-11, wherein the suction side shank profile is in accordance with at least 85% of the X, Y, and Z coordinate values listed in Table 2.

Embodiment 13. A turbine component comprising a dovetail portion; a shank portion extending between the dovetail portion and a platform; and an airfoil extending from the platform to a blade tip, the shank portion having an uncoated nominal pressure side profile substantially in accordance with Cartesian coordinate values of X, Y, and Z set forth in Table 1, wherein the X, Y, and Z coordinates are distances in inches measured in a Cartesian coordinate system, wherein, at each Z distance, the corresponding X and Y coordinates, when connected by a smooth continuous arc, define one of a plurality of pressure side shank profile section edges, and wherein the plurality of pressure side shank profile section edges, when joined together by smooth continuous arcs, form a pressure side shank portion shape, the shank portion having an uncoated nominal suction side profile substantially in accordance with Cartesian coordinate values of X, Y, and Z set forth in Table 2, wherein the X, Y, and Z coordinates are distances in inches measured in a Cartesian coordinate system, wherein, at each Z distance, the corresponding X and Y coordinates, when connected by a smooth continuous arc, define one of a plurality of suction side shank profile section edges, and wherein the plurality of suction side shank profile section edges, when joined together by smooth continuous arcs, form a suction side shank portion shape.

Embodiment 14. The turbine component of embodiment 13, wherein the dovetail portion, the shank portion, the platform, and the airfoil portion form at least part of a turbine blade, wherein the turbine blade is a stage two turbine blade.

Embodiment 15. The turbine component of any of embodiments 13-14, wherein the dovetail portion is configured to couple with a rotor disc of a turbine.

Embodiment 16. The turbine component of any of embodiments 13-15, wherein the pressure side shank portion shape lies within an envelope of +/−0.120 inches measured in a direction normal to any of the plurality of shank profile section edges and the suction side shank portion shape lies within an envelope of +/−0.120 inches measured in a direction normal to any of the plurality of shank profile section edges.

Embodiment 17. The turbine component of any of embodiments 13-16, wherein the pressure side shank portion shape lies within an envelope of +/−0.080 inches measured in a direction normal to any of the plurality of shank profile section edges and the suction side shank portion shape lies within an envelope of +/−0.080 inches measured in a direction normal to any of the plurality of shank profile section edges.

Embodiment 18. The turbine component of any of embodiments 13-17, wherein the pressure side shank portion shape lies within an envelope of +/−0.020 inches measured in a direction normal to any of the plurality of shank profile section edges and the suction side shank portion shape lies within an envelope of +/−0.020 inches measured in a direction normal to any of the plurality of shank profile section edges.

Embodiment 19. The turbine component of any of embodiments 13-18, wherein the pressure side shank profile is in accordance with at least 85% of the X, Y, and Z coordinate values listed in Table 1 and Table 2.

Embodiment 20. The turbine component of any of embodiments 13-19, further comprising a coating applied to an outer surface of the turbine component, the coating having a thickness of less than or equal to 0.010 inches.

Embodiment 21. Any of the aforementioned embodiments 1-20, in any combination.

The subject matter of this disclosure has been described in relation to particular embodiments, which are intended in all respects to be illustrative rather than restrictive. Alternative embodiments will become apparent to those of ordinary skill in the art to which the present subject matter pertains without departing from the scope hereof. Different combinations of elements, as well as use of elements not shown, are also possible and contemplated.

What is claimed is:

1. A turbine component comprising:

a dovetail portion;

a shank portion extending between the dovetail portion and a platform; and an airfoil extending from the platform to a blade tip, the shank portion having an uncoated nominal pressure side profile in accordance with Cartesian coordinate values of X, Y, and Z set forth in Table 1, wherein the X, Y, and Z coordinates are distances in inches measured in the Cartesian coordinate system, wherein, at each Z distance, the corresponding X and Y coordinates, when connected by a smooth continuous arc, define one of a plurality of shank profile section edges, wherein the plurality of shank profile section edges, when joined together by smooth continuous arcs, form a pressure side shank portion shape, wherein the pressure side shank portion shape lies within an envelope of +/−0.120 inches measured in a direction normal to any of the plurality of shank profile section edges, and wherein the pressure side shank profile is in accordance with at least 85% of the X, Y, and Z coordinate values listed in Table 1.

2. The turbine component of claim 1, wherein the dovetail portion, the shank portion, the platform, and the airfoil portion form at least part of a turbine blade.

3. The turbine component of claim 1, wherein the pressure side shank portion shape lies within an envelope of +/−0.080 inches measured in the direction normal to any of the plurality of shank profile section edges.

4. The turbine component of claim 1, wherein the pressure side shank portion shape lies within an envelope of +/−0.020 inches measured in the direction normal to any of the plurality of shank profile section edges.

5. A turbine component comprising:

a dovetail portion;

a shank portion extending between the dovetail portion and a platform; and an airfoil extending from the platform to a blade tip, the shank portion having an uncoated nominal suction side profile in accordance with Cartesian coordinate values of X, Y, and Z set forth in Table 2, wherein the X, Y, and Z coordinates are distances in inches measured in the Cartesian coordinate system, wherein, at each Z distance, the corresponding X and Y coordinates, when connected by a smooth continuous arc, define one of a plurality of shank profile section edges, wherein the plurality of shank profile section edges, when joined together by smooth continuous arcs, form a suction side shank portion shape, wherein the suction side shank portion shape lies within an envelope of +/−0.120 inches measured in a direction normal to any of the plurality of shank profile section edges, and wherein the suction side shank profile is in accordance with at least 85% of the X, Y, and Z coordinate values listed in Table 2.

6. The turbine component of claim 5, wherein the dovetail portion, the shank portion, the platform, and the airfoil portion form at least part of a turbine blade.

7. The turbine component of claim 5, wherein the suction side shank portion shape lies within an envelope of +/−0.080 inches measured in the direction normal to any of the plurality of shank profile section edges.

8. The turbine component of claim 5, wherein the suction side shank portion shape lies within an envelope of +/−0.020 inches measured in the direction normal to any of the plurality of shank profile section edges.

9. A turbine component comprising:

a dovetail portion;

a shank portion extending between the dovetail portion and a platform; and an airfoil extending from the platform to a blade tip, the shank portion having an uncoated nominal pressure side profile in accordance with Cartesian coordinate values of X, Y, and Z set forth in Table 1, wherein the X, Y, and Z coordinates are distances in inches measured in the Cartesian coordinate system, wherein, at each Z distance, the corresponding X and Y coordinates, when connected by a smooth continuous arc, define one of a plurality of pressure side shank profile section edges, and wherein the plurality of pressure side shank profile section edges, when joined together by smooth continuous arcs, form a pressure side shank portion shape, the shank portion having an uncoated nominal suction side profile in accordance with Cartesian coordinate values of X, Y, and Z set forth in Table 2, wherein the X, Y, and Z coordinates are distances in inches measured in the Cartesian coordinate system, wherein, at each Z distance, the corresponding X and Y coordinates, when connected by a smooth continuous arc, define one of a plurality of suction side shank profile section edges, and wherein the plurality of suction side shank profile section edges, when joined together by smooth continuous arcs, form a suction side shank portion shape, wherein the pressure side shank portion shape lies within an envelope of +/−0.120 inches measured in a direction normal to any of the plurality of shank profile section edges and the suction side shank portion shape lies within an envelope of +/−0.120 inches measured in a direction normal to any of the plurality of shank profile section edges, and wherein the pressure side shank profile is in accordance with at least 85% of the X, Y, and Z coordinate values listed in Table 1 and Table 2.

10. The turbine component of claim 9, wherein the dovetail portion, the shank portion, the platform, and the airfoil portion form at least part of a turbine blade, wherein the turbine blade is a stage two turbine blade.

11. The turbine component of claim 9, wherein the dovetail portion is configured to couple with a rotor disc of a turbine.

12. The turbine component of claim 9, wherein the pressure side shank portion shape lies within an envelope of +/−0.080 inches measured in the direction normal to any of the plurality of shank profile section edges and the suction side shank portion shape lies within an envelope of +/−0.080 inches measured in the direction normal to any of the plurality of shank profile section edges.

13. The turbine component of claim 9, wherein the pressure side shank portion shape lies within an envelope of +/−0.020 inches measured in the direction normal to any of the plurality of shank profile section edges and the suction side shank portion shape lies within an envelope of +/−0.020 inches measured in the direction normal to any of the plurality of shank profile section edges.

14. The turbine component of claim 9, further comprising a coating applied to an outer surface of the turbine component, the coating having a thickness of 0.010 inches.

* * * * *